US005697032A

United States Patent [19]

Kimura et al.

[11] Patent Number: 5,697,032

[45] Date of Patent: Dec. 9, 1997

[54] TRANSFER DRUM HAVING A PUSHING MEMBER FOR INCREASING THE CONTACT WIDTH OF THE TRANSFER REGION

[75] Inventors: Yoichi Kimura, Kawaguchi; Isao Kumada, Yamato; Takashi Hasegawa, Ageo; Satoshi Tamura, Yokohama, all of Japan

[73] Assignee: Canon Kabushiki Kaisha, Tokyo, Japan

[21] Appl. No.: 779,970

[22] Filed: Dec. 23, 1996

Related U.S. Application Data

[63] Continuation of Ser. No. 372,166, Jan. 12, 1995, abandoned.

[30] Foreign Application Priority Data

Jan. 12, 1994 [JP] Japan ..... 6-014805

[51] Int. Cl.[6] ..... G03G 15/14

[52] U.S. Cl. ..... 399/302; 399/313

[58] Field of Search ..... 399/302, 303, 399/304, 308, 313

[56] References Cited

U.S. PATENT DOCUMENTS

| | | | |
|---|---|---|---|
| 4,101,212 | 7/1978 | Sumiyoshi et al. | 355/274 |
| 4,914,737 | 4/1990 | Amemiya et al. | 355/276 |
| 5,019,872 | 5/1991 | Takeda et al. | 355/309 |
| 5,081,501 | 1/1992 | Waki et al. | 355/274 |
| 5,084,736 | 1/1992 | Suzuki et al. | 355/271 |
| 5,091,751 | 2/1992 | Inoue et al. | 355/274 |
| 5,132,737 | 7/1992 | Takeda et al. | 355/271 |
| 5,172,172 | 12/1992 | Amemiya et al. | 355/271 |
| 5,189,479 | 2/1993 | Matsuda et al. | 355/274 |

*Primary Examiner*—Nestor R. Ramirez

*Attorney, Agent, or Firm*—Fitzpatrick, Cella, Harper & Scinto

[57] ABSTRACT

An image forming apparatus includes an image bearing member for bearing an image, a movable recording material carrying member for carrying a recording material on a first side thereof, the recording material carrying member cooperating with the image bearing member to form a nip therebetween, a transfer charging member, to which a voltage is applicable, the transfer charging member being contactable to a second side of the recording material carrying member to transfer in the nip an image from the image bearing member onto a recording material carried on the recording material carrying member, a pushing member for pushing the second surface of the recording material carrying member at a first position of the recording material carrying member to increase a width, measured along a movement direction of the recording material carrying member, of the nip, wherein the first position is remote from a second position where the transfer charging member is contactable to the recording material carrying member.

27 Claims, 4 Drawing Sheets

TRANSFER DRUM HAVING A PUSHING MEMBER FOR INCREASING THE CONTACT WIDTH OF THE TRANSFER REGION

This application is a continuation of application Ser. No. 08/372,166 filed Jan. 12, 1995 now abandoned.

FIELD OF THE INVENTION AND RELATED ART

The present invention relates to an image forming apparatus such as a laser beam printer or a copying machine of an electrostatic recording type or an electrophotographic type or the life, more particularly to an image forming apparatus transferring onto a recording material on a recording material carrying member an image formed on an image bearing member.

Heretofore, as a transfer charging means for transferring onto the recording material the toner image (the visualized image) formed on the image bearing member, in the image forming apparatus (,for example, the copying machine, the laser beam printer or the like) of the electrostatic recording type or the electrophotographic type, a charging brush and a contact type charging roller are known.

The charging member,for example, is disposed within a transfer drum to form a transfer nip portion with a photosensitive drum as the image bearing member to transfer, onto the recording material carried on the transfer drum surface, the toner image formed on the photosensitive drum.

At this time the charging member to carry out the proper transfer in the transfer nip portion, urges, to the photosensitive drum 1, the recording material on the transfer drum by pushing it at the inside of the transfer drum.

However, in the above-described conventional example, the photosensitive drum and the transfer drum at least in the transfer nip portion are in the form of arcs.

In this case, the photosensitive drum and the transfer drum make line contact along %he generating lines of the both, so that the contact area (the nip width) is substantially very narrow.

The contact charging member is contacted to the inside surface of the transfer drum in the transfer nip portion and the electric field extends even to the small gap between the transfer drum and the photosensitive drum formed upstream side and downstream of the transfer nip portion, so that abnormal discharge or the like is produced. If this occurs, the toner image on the photosensitive drum is disturbed, by the abnormal discharge, by which an image defect results. Such a phenomenon tends to occur in the case of high potential of the contact charging member, particularly.

SUMMARY OF THE INVENTION

The object of the present invention is to provide an image forming apparatus wherein the abnormal discharge is prevented adjacent the transfer portion.

Another object of the present invention is to provide an image forming apparatus in which the width at the nip portion between the recording material carrying member and the image bearing member is expanded.

A further object of the present invention is to provide an image forming apparatus wherein a transfer defect due to the abnormal discharge of the transfer charging member in contact with the back side of the recording material carrying member is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
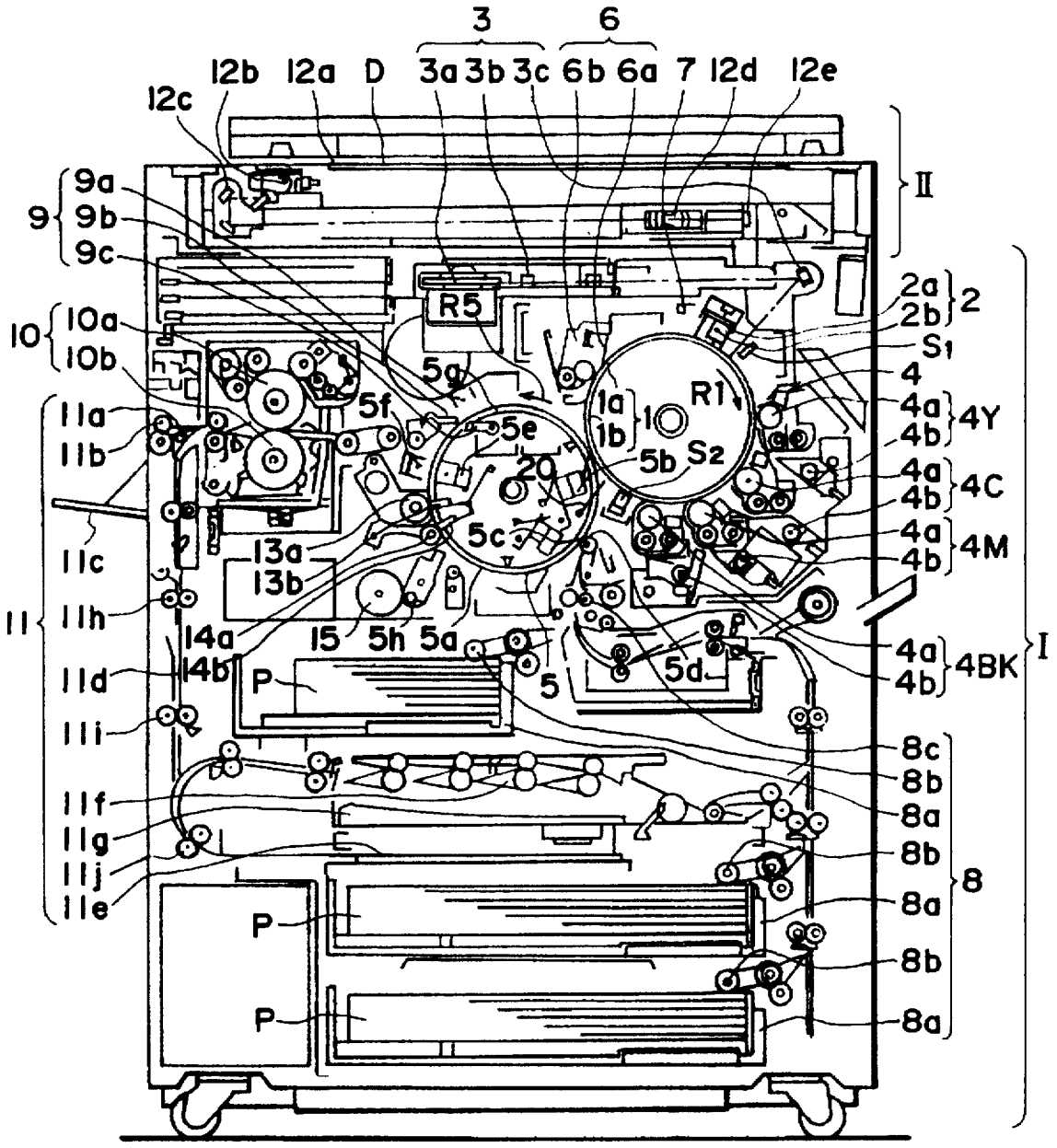
FIG. 1 is a longitudinal section of a structure in an example of an image forming apparatus according to the present invention.

The embodiments of the present invention will be described in conjunction with the drawing.

Referring to FIG. 1, as an example of the image forming apparatus according to the present invention, there is shown an image forming apparatus of the digital 4 full-color type, the image forming apparatus shown in the Figure is provided with a digital color image printer portion, which will hereinafter be called "printer portion" I in the lower portion, and a digital color image reader portion, which will hereinafter be called "reader portion" II in the upper portion, and for example, the image is formed on a recording material P by the printer portion I in accordance with the image of the original D read by the reader portion I.

The structure of the printer portion I and the structure of the reader portion I will be described briefly.

The printer portion I comprises a photosensitive drum 1 having a diameter of 180 mm as the image bearing member rotatably mounted in the direction of an arrow R1.

Around the circumference of the photosensitive drum 1, in the order along rotational direction, there are arranged a primary charger (the charging means) 2, an exposure means 3, a developing device (the developing means) 4, a transfer device 5, a cleaner 6, a pre-exposure lamp 7 and the like.

Below the transfer device 5, that is, in the lower part of the printer portion I, a sheet feeding transportation portion 8 for the recording material P is disposed, and in the upper portion of the transfer device 5, the separation means 9 is disposed, and downstream of the separation means 9 (in the recording material P transportation direction) a fixing device 10 and a sheet discharge portion 1 are arranged.

The photosensitive drum 1 includes the drum-like base 1*a* made from aluminum and the photosensitive member 1*b* of OPC (organic photoconductor) covering the surface thereof, and is rotated at a predetermined process speed (the peripheral speed) in the direction of the arrow R1 by a driving means (not shown).

The photosensitive drum will be described detail hereinafter 1.

The primary charger 2 is a corona charger having a shield 2*a* opening at the portion opposed to the photosensitive drum 1, a discharge wire 2b disposed parallel to the generating line of the photosensitive drum 1 inside the shield 2a, and a grid (not shown) confining the charge potential by being disposed at the opening portion of the shield 2a.

The primary charger 2 is s supplied with a charging bias from a voltage source (not shown) to uniformly charge the photosensitive drum 1 surface to the predetermined potential in the predetermined polarity.

The exposure means 3 includes a laser output portion (not shown) for emitting the laser light based on the image signal from the reader portion I which will be described hereinafter, a polygonal mirror 3a for reflecting the laser light, a lens 3b and a mirror 3c.

The exposure means 3 exposes the photosensitive drum 1 by projecting the laser light to the photosensitive drum 1 so that the charge of the exposure portion is removed, thus forming an electrostatic latent image.

In this embodiment, as to the electrostatic latent image formed on the surface of the photosensitive drum 1, the original image is color-separated to the yellow, the cyan, the magenta, the black color images, and the electrostatic latent image corresponding to the respective colors are sequentially formed.

The developing device 4 is provided with four developing devices in the order from the upstream side along the rotational direction of (the arrow R1 direction) the photosensitive drum 1, namely, developing devices 4Y, 4C, 4M, 4Bk accommodating toner (developer) of respective colors of yellow, cyan, magenta, black toners comprising, as a major component, resin material.

Each developing device 4Y, 4C, 4M, 4Bk includes a developing sleeve 4a for deposing the toner to the electrostatic latent image formed at the surface of the photosensitive drum 1. The developing device for the predetermined color to be operated for the developing operation for the electrostatic latent image, is selectively brought to the developing position close to the surface of the photosensitive drum 1, by the eccentricity cam 4b, and the toner is deposed onto the electrostatic latent image by way of the developing sleeve 4a, so as to form a toner image (a visual image) as the visualized image. The developing devices for other 3 colors, are kept retracted from the developing position.

The transfer device 5 includes a transfer drum (a recording material carrying member) 5a having a diameter of 180 mm for carrying the recording material P on the surface thereof, a transfer charger (a transfer charging means) 5b for transferring to the recording material P the toner image from the photosensitive drum 1, an attraction charger 5c for attracting the recording material P to the transfer drum 5a, an attraction roller 5d opposed to it, an inside charger 5e, and an outside charger 5f. In the peripheral surface opening area of the transfer drum 5a supported for rotation in the direction of an arrow R5, a recording material carrying sheet 5g of a dielectric material is stretched integrally into a cylindrical form.

The recording material carrying sheet 5g is of a dielectric material such as a polycarbonate film.

The transfer device 5 caries the recording material P by attracting it on the surface of the transfer drum 5a.

The cleaner 6 is provided with a cleaning blade 6a for scraping residual toner remaining on the surface of the photosensitive drum 1 without being transferred to the recording material P, and a cleaning container 6b for collecting the scraped toner The pre-exposure lamp 7 is disposed adjacent upstream of the primary charger 2 to remove the unnecessary charge on the surface of the photosensitive drum 1 having been cleaned by the cleaner 6.

The sheet feeding transportation portion 8 includes a plurality of sheet feeding cassettes 8a for stacking the recording material P having different sizes, a sheet feeding roller 8b for feeding the recording material P from the sheet feeding cassette 8a, a number of feeding rollers, and, a registration roller 8c and so on. It functions to supply to the transfer drum 5a the recording material P of a predetermined size.

The separation means 9 includes a separation charger 9a for the recording material P separating from the transfer drum 5a after the toner image transfer, separation claws 9b and, a separation push roller 9c and so on.

The fixing device 10 includes a fixing roller 10a having a heater therein and a pressing roller 10b which is disposed below the fixing toiler 10a and which urges the recording material P to the fixing roller 10a.

The sheet discharge portion 11 includes a guide 11a for switching the transportation path, which is arranged at the fixing device 10, a discharge roller 11b, a sheet discharge tray 11c and so on.

Below the guide 1a 4 a transportation path switch, there are arranged, in order to executes the image forming on both of the surface on one recording material P, a transportation vertical path 11d, a reversion path 11e, a stacking member 11f an intermediate tray 11g, a feeding roller 11h 11i a reversion roller 11j or the like.

Between the developing device 4 and the primary charger 2 adjacent the periphery of the photosensitive drum 1, the potential sensor S1 for detecting the charge potential on the photosensitive drum surface, is disposed, and between the transfer drum 5a and the developing device 4, a density sensor S2 for detecting the density of the toner image on the photosensitive drum 1, is disposed.

The Description will be made as to the reader portion I.

The reader portion I disposed above the printer portion I, comprises an original carriage glass 12a for supporting the original D, a movable exposure lamp 12b for scanning the image plane of the original D while moving, a plurality of mirrors 12c for reflecting the reflection light from the original D, a lens 12d for condensing the reflected light, and, the full-color sensor 12e for generating the color separation image signal on the basis of the light from the lens 12d and so on.

The color separation image signal is processed by a video processing unit (not shown) through an amplifier (not shown), and is transmitted to printer portion I described above.

The operation will be described.

In the following description, the yellow, the cyan, the magenta, the black images, are formed in this order.

The image of the original D stacked on the original carriage glass 12a of the reader portion I, is projected by the exposure lamp 12b, and, the color-separated yellow image is read by the full-color sensor 12e, and is processed in the predetermined manner and is fed to the printer portion I.

In the printer portion I, the photosensitive drum 1 is rotated in the direction of the arrow R1, and the surface is charged uniformly by the primary charger 2.

On the basis of the image signal fed from the above-described reader portion I, the laser light is projected from the laser output portion of the exposure means 3, and the charged photosensitive drum 1 surface is exposed to the light image E through the polygonal mirror 3a and the like.

From the portion having been subjected to the exposure on the surface the photosensitive drum 1, the charge is removed, and by this the electrostatic latent image corresponding to the yellow component is formed, in the developing device 4, the developing device 4Y for the yellow is brought to the predetermined developing position, and the other developing device 4C, 4M, 4Bk are kept retracted from the developing position.

The electrostatic latent image on the photosensitive drum 1 is developed with the yellow toner by the developing device 4Y into a visualized toner image.

The yellow toner image on the photosensitive drum 1, is transferred onto the recording material P carried on the transfer drum 5*a*.

The recording material P of the size suiting to the original image has been supplied to the transfer drum 5*a* at the predetermined timing through the sheet feeding roller 8*b*, the feeding roller, and the registration roller 8*c* and the like from the predetermined sheet feeding cassette 8*a*.

The recording material P supplied in this manner, is attracted in a winding fashion on the surface of the transfer drum 5*a* to rotate in the direction of the arrow R5, and the yellow toner image on the photosensitive drum 1 is transferred by the transfer charger 5*b*.

On the other hand, the photosensitive drum 1 after the toner image transfer, is cleaned so that the residual toner is removed from the surface by the cleaner 6, and the unnecessary charge is removed by the pre-exposure lamp 7 so as to be prepared for the next image forming starting at the primary charging.

The reading operation for the original image by the reader portion I, the transfer operation of the toner image to the recording material P from the transfer drum 5*a*, the cleaning of the photosensitive drum 1 and the electric discharging, are executed similarly also as to the cyan, the magenta, the black colors so that 4 color toner images are transferred so as to be overlaid on the transfer material P on the transfer drum 5*a*.

The recording material P having been subjected to the 4 color transfer, is separated from the transfer drum 5*a* by the separation charger 9*a*, the separation claw 9*b* or the like, and is transported to the fixing device 10 in the state in which it caries on the surface thereof the toner image unfixed.

The recording material P is heated and pressed by the heating roller 10*a* and the pressing roller 10*b* the fixing device 10, and the toner image on the surface is fused and fixed. The recording material P after the fixing, is discharged onto the sheet discharge tray 1*c* by the discharge roller 1*b*.

In the case that the image are to be formed on surfaces the both of the recording material P the recording material P, after the discharge from the fixing device 10, the recording material P is fed by the guide 1*a* immediately driven, and is introduced temporarily to the reversion path 1*e*, through the transportation vertical path 1*d*, and thereafter, it is refed with the trailing edge when it is fed in, at the head, by the reverse rotation of the reversion roller 1*j* in the opposite direction, so that it is accommodated in the intermediate tray 1*g*. Thereafter, the image is formed on the opposite surface by the above-described image forming process and then it is discharged onto the sheet discharge tray 1*c*.

On the transfer drum 5*a* after the separation of the recording material P, in order to prevent the scattering deposition of the particles to the recording material carrying sheet 5*g*, and the deposition of the oil on the recording material P or the like, a furbrush 13*a* and a back-up brush 13*b*, opposed to to each other with the recording material carrying sheet 5*g* therebetween, and the oil removal roller 14*a* and the back-up brush 14*b* are used to execute the cleaning.

Such a cleaning is carried out after the image forming operation or before the image forming operation, and in addition, it is carried out as desired upon the occurrence of the jam (the sheet jam).

EMBODIMENT 1

Figure 2:
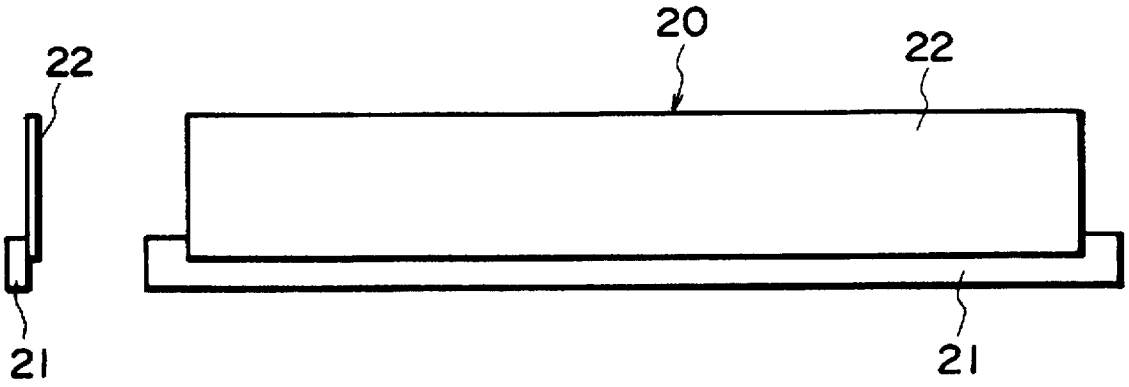
FIG. 2 is a side view and a front view of a push upper member of the embodiment 1.
Figure 3:
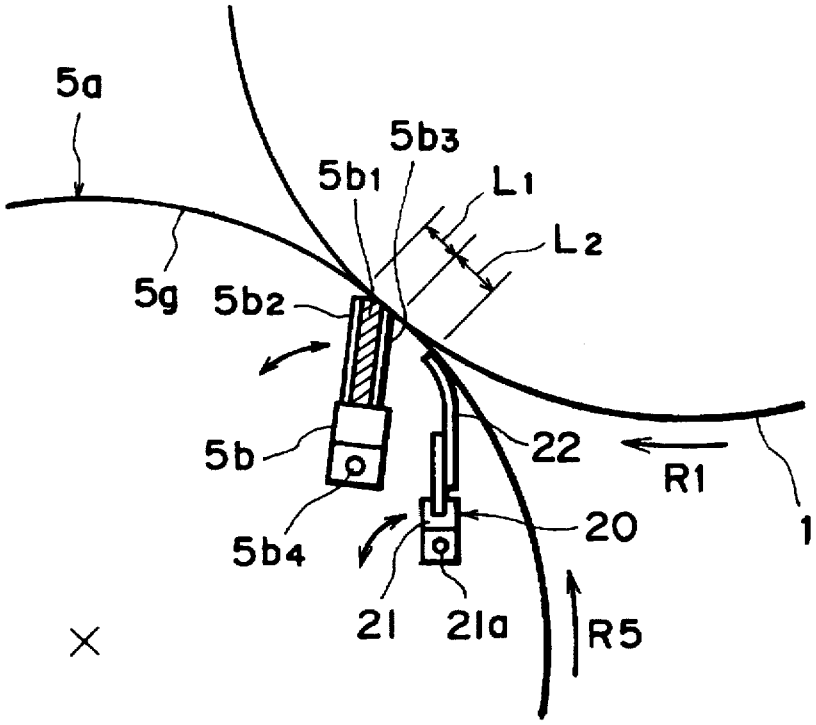
FIG. 3 there is by the operation illustration of a pushing member of embodiment 1.

FIG. 3 is an enlarged view around the transfer portion of FIG. 1. FIG. 2 is a front view and a side view of a pre-transfer pushing plate 20.

As shown in FIG. 3, the pre-transfer pushing plate (the pushing plate member) 20 as an expanding means, is disposed inside the recording material carrying sheet 5*g* of the transfer drum 5*a*.

The pre-transfer pushing plate 20, as shown in FIG. 2, comprises a base plate 21 of metal and a blade 22 comprising She dielectric member (polyethylene terephthalate) having a thickness of 188 mm stretched thereto.

As shown in FIG. 3, the pre-transfer pushing plate 20, when the recording material P passes at the transfer station by an unshown driving means (a driving portion), the shaft 21*a* is moved in the direction of the arrow to the center in synchronism with movement of the transfer charger 5*b* in the direction of the arrow about a shaft $5b_4$, and to push the recording material carrying sheet 5*g* up to the outside from the inside so that the recording material P attracted on the surface thereof together with the recording material carrying sheet 5*g* is pressed to the photosensitive drum 1.

The transfer charger 5*b* comprises an electroconductive brush 5*b*1 as the transfer charging member of a carbon dispersed rayon fur and a polyethylene terephthalate plates 5*b*2, 5*b*3 of the dielectric material sheets having thicknesses of 270 and 50 macaroons sandwiching it. The total pressure (the line pressure force) during the operation, is 200 gf, and the nip width provided by the transfer charger 5*b* alone, (the width at the transfer nip portion which is the contact portion between the recording material carrying sheet 5*g* and the image bearing member 1)L1 is, 2 mm.

During the pushing plate 20 operation, the leading edge of the plate e is 2 mm upstream of the transfer nip, and the bent portion of the blade 22 is affective, the nip width (L1+L2) is enlarged to the approx. 5 mm in total.

The nip width of L1 of only 2 mm, is enlarged by 3 mm (L2) to upstream, by the push up action of the pushing plate 20 into total approx. 5 mm.

When the recording material P dries under the low humidity ambience, it is desirable that transfer voltage is higher than that under the high humidity ambience, in order to properly transfer to the recording material P on the recording material carrying sheet 5*g* the toner image formed on the surface of the photosensitive drum 1.

In the case of the conventional device not having the pushing plate 20 as described hereinbefore, the nip width of L1 is only 2 mm. in this case, the voltage exceeding 2.3 kv (under the condition that the transfer voltage of 2.8 kV is applied to the brush 5*b*1 under the low humidity ambience) results in the occurrence of the nip-inside discharge results, and a white dot-like discharge pattern is formed on the image.

The cause of the the white dot-like pattern is considered that the tenet is charged to the polarity opposite from the normal polarity due to the abnormal discharge before the transfer. On the contrary, in the case that the pushing plate 20 is mounted, the nip width (L1+L2) is 5 mm, and even when the transfer voltage applied to the brush 5b1 is the same 2.8 kV, the discharge threshold rises to 3.4 kV.

Figure 7:
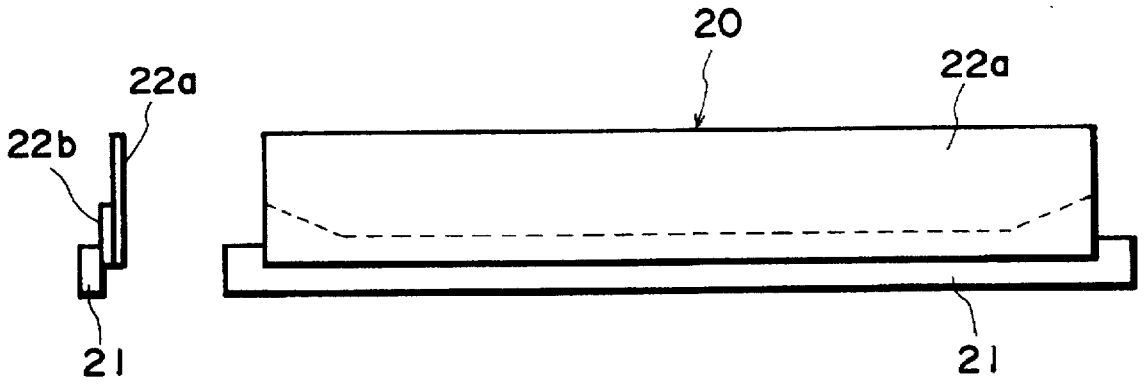
FIG. 7 is a side view and a front view of a pushing member.

By this, in the full-color image forming apparatus shown in FIG. 1 using the above-described pushing plate 20, the abnormal discharge does not occur, also under the condition of the low humidity, the proper transfer image can be provided. The pressure to the carrying sheet 5g by the pushing plate 20 tends to decrease at the end portion beyond the middle portion, and therefore as indicated in FIG. 7, the polyethylene terephthalate films 22a, 22b of 2 sheets are preferably provided, and the length of the film 22b preferably made larger toward the end portion.

EMBODIMENT 2

Figure 4:
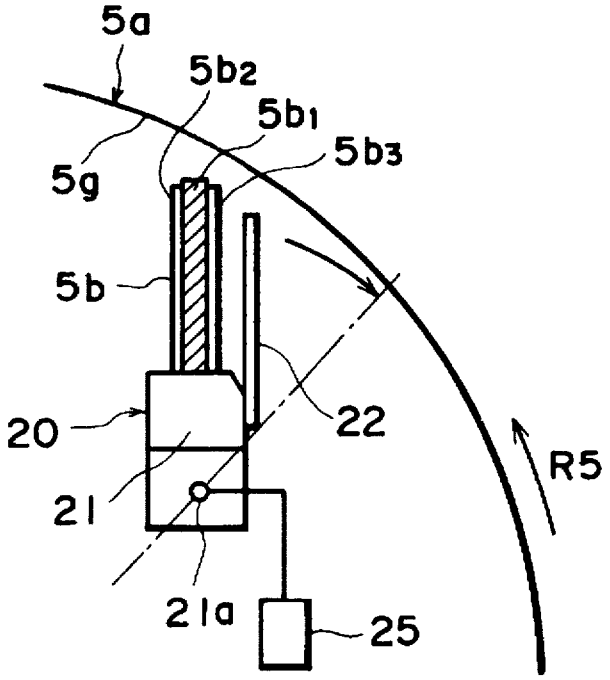
FIG. 4 illustrates an operation of a pushing member of embodiment 2.

As shown in FIG. 4, the pre-transfer pushing plate 20 and the transfer charger 5b may be integral. By doing so, a driving mechanism for them may be common, thus simplifying the structure. FIG. 4 shows a driving member 25 such as a solenoid for moving the pre-transfer pushing plate 20 and transfer charger 5b toward and away from the carrying sheet. The pre-transfer pushing plate 20 and transfer charger 5b are contacted to the carrying sheet when the recording material is at the transfer position. However, when the integral structure is used, the balance between the pressure (line pressure) between the pre-transfer pushing plate 20 and transfer charger 5b. Here, the line pressure means the force per unit length of the carrying sheet in its longitudinal direction. As a result of experiments, it has been confirmed that the transfer charger 5b is not sufficiently contacted to the carrying sheet if the total pressure (line pressure) of the pre-transfer pushing plate 20 is larger than the total pressure (line pressure) of the transfer charger 5b. So, image transfer defect occurs. Accordingly, the total pressure between the transfer charger 5b and the carrying sheet is made larger than the total pressure between the pre-transfer pushing plate 20 and the carrying sheet. The blade 22 of the pre-transfer pushing plate 20 is made from a polyethelenetelephtalate plate having a thickness of 188 microns, and the pressure balance is such that 180 gf for the transfer charger 5b, and 140 gf for pre-transfer pushing plate 20. It has been confirmed that the same effects as in the first embodiment are provided. Plates 5b2 and 5b3 function to limit the transfer electric field.

EMBODIMENT 3

Figure 5A:
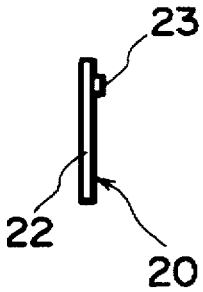
FIG. 5 consists of FIG. 5A which is a side view and FIG. 5B which is a front view drawing of a pushing member of embodiment 3.
Figure 5B:
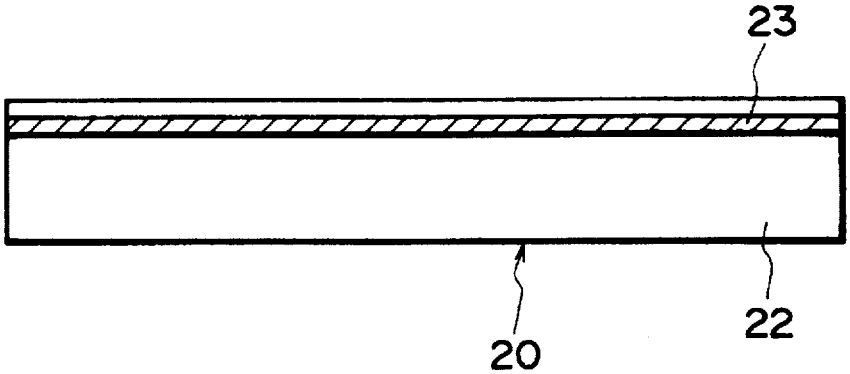
Figure 6:
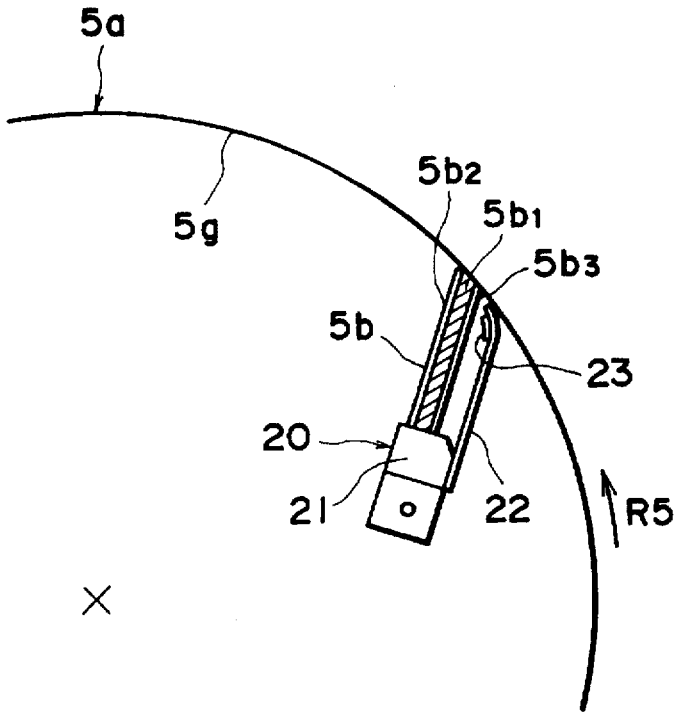
FIG. 6 illustrates the operation of a pushing member of embodiment 3.

Referring to FIGS. 5 and 6, a third embodiment will be described, wherein in place of the pushing member, an electroconductive tape 23 (conductive member) is bonded to a back side of the blade 22 of the pre-transfer pushing plate 20. Particularly when the use is made with a charging brush as transfer charger 5b, the transfer efficiency of the transfer charger 5b tends to be non-uniform, with the result that the charging starts at a position where the voltage is highest in the longitudinal direction. The non-uniformity can be reduced by properly selecting a shape, a material, position or the like of the transfer charger 5b, but the variation is fundamentally unavoidable.

In this embodiment, a conductive tape of a predetermined width is bonded and extended in a longitudinal direction on the back side of the blade 22 adjacent the transfer charger 5b, as shown in FIG. 6 to eliminate the non-uniformity of the intensity of the electric field, thus accomplishing satisfactory electric discharge.

In embodiments 1–3, a distance between a position where transfer charger 5b is in contact with the carrying sheet to a position where the pre-transfer pushing plate 20 is in contact with the carrying sheet, is 2 mm. In order to prevent abnormal discharge before the image transfer, the distance is not more than 10% of the diameter of the transfer drum, preferably, not more than 5% thereof. If the transfer charger 5b and the sheet 22 of the pre-transfer pushing plate 20 are contacted to each other, the charging-up of the plate 5b3 may result in that the sheet 22 is charged so that the electric discharge tends to occur before the transfer action, and therefore, the transfer charger 5b and the sheet 22 are away from each other, preferably.

As described in the foregoing, the width of the transfer nip formed between the image bearing member and the recording material carrying member is expanded, by which a discharge threshold level of the transfer charging member upon the image transfer operation from the image bearing member onto the recording material carrying member, so that image defect attributable to the abnormal discharge can be avoided.

While the invention has been described with reference to the structures disclosed herein, it is not confined to the details set forth and this application is intended to cover such modifications or changes as may come within the purposes of the improvements or the scope of the following claims.

What is claimed:

1. An image forming apparatus comprising:

an image bearing member for bearing an image;

a movable recording material carrying member for carrying a recording material on a first side thereof, said recording material carrying member being cooperable with said image bearing member to form a nip therebetween and having a second side opposite to the first side;

a transfer charging member, to which a voltage is applicable, contactable to a second side of said recording material carrying member to transfer in the nip an image from said image bearing member onto a recording material carried on said recording material carrying member; and a pushing member for pushing the second side of said recording material carrying member at a first position of said recording material carrying member to increase a width, measured along a movement direction of said recording material carrying member, of the nip, wherein said first position is remote from a second position where said transfer charging member is contactable to said recording material carrying member, wherein said pushing member is contacted to said recording material carrying member at a total pressure which is smaller than a total pressure at which said transfer charging member is contacted to said recording material carrying member.

2. An apparatus according to claim 1, wherein said pushing member is disposed upstream of said transfer charging member in the movement direction of said recording material carrying member.

3. An apparatus according to claim 2, wherein said recording material carrying member is cylindrical, and a distance between the first position and the second position is not more than 10% of a diameter of said recording material carrying member.

4. An apparatus according to claim 2, further comprising a limiting member for limiting an electric field provided by said transfer charging member, wherein said limiting member is contactable to said transfer charging member at a position downstream of said pushing member and upstream of said transfer charging member, and is away from said pushing member.

5. An apparatus according to claim 4, wherein said limiting member is of a dielectric material.

6. An apparatus according to claim 5, wherein said limiting member comprises a resin material.

7. An apparatus according to claim 1, wherein said recording material carrying member is cylindrical.

8. An apparatus according to claim 1, further comprising a supporting member for supporting said transfer charging member and said pushing member.

9. An apparatus according to claim 8, further comprising common driving means for moving said transfer charging member and said pushing member toward end away from said recording material carrying member.

10. An apparatus according to claim 1, wherein said pushing member is of dielectric sheet.

11. An apparatus according to claim 1, wherein said pushing member includes a dielectric sheet and an electrically conductive member supported by said dielectric sheet.

12. An apparatus according to claim 1, further comprising a limiting member for limiting an electric field provided by said transfer charging member, wherein said limiting member is contactable to said transfer charging member between said transfer charging member and said pushing member, and is away from said pushing member.

13. An apparatus according to claim 1, wherein a plurality of colors of toner images can be transferred onto the recording material carried on said recording material carrying member.

14. An image forming apparatus comprising:

an image bearing member for bearing an image;

a movable recording material carrying member for carrying a recording material on a first side thereof, said recording material carrying member being cooperable with said image bearing member to form a nip therebetween;

a transfer charging member, to which a voltage is applicable, contactable to a second side of said recording material carrying member to transfer in the nip an image from said image bearing member onto a recording material carried on said recording material carrying member;

a pushing member for pushing the second side of said recording material carrying member at a first position of said recording material carrying member to increase a width, measured along a movement direction of said recording material carrying member, of the nip, wherein said first position is remote from a second position where said transfer charging member is contactable to said recording material carrying member; and common driving means for moving said transfer charging member and said pushing member toward and away from said recording material carrying member.

15. An apparatus according to claim 14, wherein said pushing member is disposed upstream of said transfer charging member in the movement direction of said recording material carrying member.

16. An apparatus according to claim 15, wherein said recording material carrying member is cylindrical, and a distance between the first position and the second position is not more than 10% of a diameter of said recording material carrying member.

17. An apparatus according to claim 15, further comprising a limiting member for limiting an electric field provided by said transfer charging member, wherein said limiting member is contactable to said transfer charging member at a position downstream of said pushing member and upstream of said transfer charging member, and is away from said pushing member.

18. An apparatus according to claim 17, wherein said limiting member is of a dielectric material.

19. An apparatus according to claim 18, wherein said limiting member comprises a resin material.

20. An apparatus according to claim 14, wherein said recording material carrying member is cylindrical.

21. An apparatus according to claim 14, further comprising a supporting member for supporting said transfer charging member and said pushing member.

22. An apparatus according to claim 21, further comprising common driving means for moving said supporting member to move said transfer charging member and said pushing member toward and away from said recording material carrying member.

23. An apparatus according to claim 14, wherein said pushing member is of dielectric sheet.

24. An apparatus according to claim 14, wherein said pushing member includes a dielectric sheet and an electrically conductive member supported by said dielectric sheet.

25. An apparatus according to claim 14, further comprising a limiting member for limiting an electric field provided by said transfer charging member, wherein said limiting member is contactable to said transfer charging member between said transfer charging member and said pushing member, and is away from said pushing member.

26. An apparatus according to claim 14, wherein a plurality of colors of toner images can be transferred onto the recording material carried on said recording material carrying member.

27. An apparatus according to claim 1 or 14, wherein said transfer charging member is slidable on said recording material carrying member.

* * * * *

UNITED STATES PATENT AND TRADEMARK OFFICE

CERTIFICATE OF CORRECTION

PATENT NO. : 5,697,032 
DATED : December 9, 1997
INVENTOR(S) : Yoichi KIMURA, et al.

It is certified that error appears in the above-indentified patent and that said Letters Patent is hereby corrected as shown below:

Column 1, line 14, delete "life" and insert therefor --like--;
Line 39, delete "%he" and insert therefor --the--.

Column 2, line 64, after "described", insert --in--.

Column 3, line 5, delete "s";
Line 41, after "for", insert --the--.

Column 4, line 17, delete "toiler" and insert therefor --roller--;
Line 25, delete "executes" and insert therefor --execute--.

Column 5, line 15, delete "suiting" and insert therefor --suited--;
Line 18, delete "and", first occurrence;
18, after"8*c*", insert a comma (",");
Line 27, after "transfer", delete the comma (",");
Line 37, delete "4 color" and insert therefor --four-color--;
Line 43, delete "caries" and insert therefor --carries--.

Column 6, line 20, delete "She" and insert therefor --the--;
Line 21, delete "mm" and insert therefor --$\mu$m--;
Line 34, delete "a" and insert therefor --the--.

UNITED STATES PATENT AND TRADEMARK OFFICE

CERTIFICATE OF CORRECTION

PATENT NO. : 5,697,032

DATED : December 9, 1997

INVENTOR(S) : Yoichi KIMURA, et al.

It is certified that error appears in the above-indentified patent and that said Letters Patent is hereby corrected as shown below:

Column 9, lines 36 and 37, delete "ther- ebetween" and insert therefor --there- between--.

Signed and Sealed this

Fourteenth Day of July, 1998

Bruce Lehman

*Attest:*

BRUCE LEHMAN

*Attesting Officer*

*Commissioner of Patents and Trademarks*